United States Patent [19]

Vonder et al.

[11] 4,066,318

[45] Jan. 3, 1978

[54] ELECTRICAL CONNECTOR ASSEMBLY

[75] Inventors: David L. Vonder, Addison; Anthony J. Wilkis, Downers Grove, both of Ill.

[73] Assignee: GTE Automatic Electric Laboratories Incorporated, Northlake, Ill.

[21] Appl. No.: 705,659

[22] Filed: July 15, 1976

[51] Int. Cl.[2] ..... H01R 13/54

[52] U.S. Cl. ..... 339/92 M; 339/184 M; 339/198 H

[58] Field of Search ..... 339/92 R, 92 M, 121, 339/176 M, 176 P, 189 M, 198 R, 198 G, 198 H, 198 P

[56] References Cited

U.S. PATENT DOCUMENTS

| | | | |
|---|---|---|---|
| 3,617,985 | 11/1971 | Kehl | 339/92 M |
| 3,850,492 | 11/1974 | Moore | 339/92 A X |
| 3,853,381 | 12/1974 | Morningstar | 339/92 M |

*Primary Examiner*—Roy Lake
*Assistant Examiner*—E. F. Desmond

[57] ABSTRACT

The disclosure relates to a stackable electrical connector assembly which includes a pin connector and terminal block means. The pin connector includes a partial enclosure having a floor and a divider wall defining first and second aligned partial enclosures. Each partial enclosure includes a plurality of apertures extending through the floor which are arranged in a predetermined array and a wire connecting pin in each aperture extending forward of the floor and terminating within the floor in between the front and rear surfaces of the floor. A block portion is adjacent each partial enclosure and includes an alignment key and a cable clamp and holder for securing a cable to each block at a desired angle to avoid unnecessary bending of the cables. The terminal block means includes a pair of identical terminal blocks each having a plurality of wire connecting pins arranged in the predetermined array and a bracket for aligning and securing the terminal blocks together. The bracket has alignment slots which are adapted to receive the alignment keys of the pin connector block portions so that when the pin connector and terminal blocks are joined, the wire connector pins of the terminal blocks are aligned with the apertures on the rear side of the pin connector floor. As a result, each pin of the terminal blocks contacts an associated pin on the pin connector to interconnect the cable wires connected to the wire connecting pins.

5 Claims, 3 Drawing Figures

ELECTRICAL CONNECTOR ASSEMBLY

BACKGROUND OF THE INVENTION

The present invention is directed to an electrical connector assembly, and in particular to a pluggable, stackable connector for use in electronic switching systems.

Electronic switching systems incorporate numerous electrical cables for interconnecting various segments and subsystems of the over-all system. In the past, such interconnections have had to be made laboriously on a per wire basis during field installation. This is time consuming for installation personnel, is expensive, and is prone to human error.

To avoid the aforementioned difficulties associated with the field installation of such systems, electrical connectors of various forms have been devised which afford factory wiring of the interconnections and only requiring field installation personnel to make appropriate plug-ins. However, the electrical connectors which have come heretofore have not provided sufficient flexibility to suit the various forms of applications which have arisen. For example, prior connectors have not been sufficiently modularized to avoid excess and unnecessary connectors or pins. This has been because of the strict alignment requirements of the various connector parts. This unfortunately results in an overly expensive interconnection system which occupies an excessive amount of valuable space.

As a still further example, prior connectors have lacked a simple but yet effective means for mounting the cables in such a way that bending of the cables and the fragile wires which they contain may be avoided. The bending of the wires can, over a period of time, cause wire damage and also unnecessary interconnection wire clutter.

It is, therefore, a general object of the present invention to provide a new and improved electrical connector assembly.

It is a further object of the present invention to provide an electrical wire connector assembly which is modularized but yet which includes means for providing the required alignment accuracy.

It is a still further object of the present invention to provide an electrical wire interconnector assembly having a cable clamp and holder which secures the cables to the connector in any one of a plurality of angular positions to avoid bending of the cable wires.

SUMMARY OF THE INVENTION

The present invention provides an electrical connector assembly of the type which affords cable wire interconnection which comprises a pin connector and a terminal block means. The pin connector includes a partial enclosure having a floor comprising a front surface and a rear surface, a first end wall, a second end wall, and a side wall, the first end wall, the second end wall, and the side wall extending forward from the floor of the front surface. The partial enclosure also includes a divider wall extending forward from the floor front surface and defining first and second aligned partial enclosure portions. The pin connector additionally includes a first plurality of apertures extending through the floor within the first portion and arranged in a predetermined array, a first plurality of wire receiving pins within the first plurality of apertures, the first plurality of pins extending forward of the floor front surface and terminating within the first plurality of apertures at a point intermediate the front and rear surfaces, a second plurality of apertures extending through the floor within the second portion and arranged in a predetermined array, a second plurality of wire receiving pins within the second plurality of apertures, the second plurality of pins extending forward of the floor front surface and terminating within the second plurality of apertures at a point intermediate the front and rear surfaces, a first block portion adjacent the first partial enclosure portion on the side opposite the side wall, the first block including a first alignment key, and a second block portion adjacent the second partial enclosure portion on the side opposite the side wall, the second block including a second alignment key. The terminal block means include a first terminal block having a first planar major surface, and a third plurality of wire receiving pins arranged in a predetermined array and extending forward of the first planar surface, a second terminal block substantially identical to the first terminal block having a second major planar surface, and a fourth plurality of wire receiving pins arranged in a predetermined array and extending forward of the second planar surface, and a bracket for aligning and securing the first and second terminal blocks together and having first and second slots for receiving the first and second aligning keys respectively. As a result, when the pin connector and the terminal block means are brought together, the first and second alignment keys and the first and second key slots respectively engage for aligning the first and second plurality of apertures with the third and fourth plurality of wire receiving pins respectively and for causing the first and second plurality of wire receiving pins to contact the third and fourth plurality of wire receiving pins respectively.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, and the several figures of which like reference numerals identify like elements, and in which:

DESCRIPTION OF A PREFERRED EMBODIMENT

Figure 1:
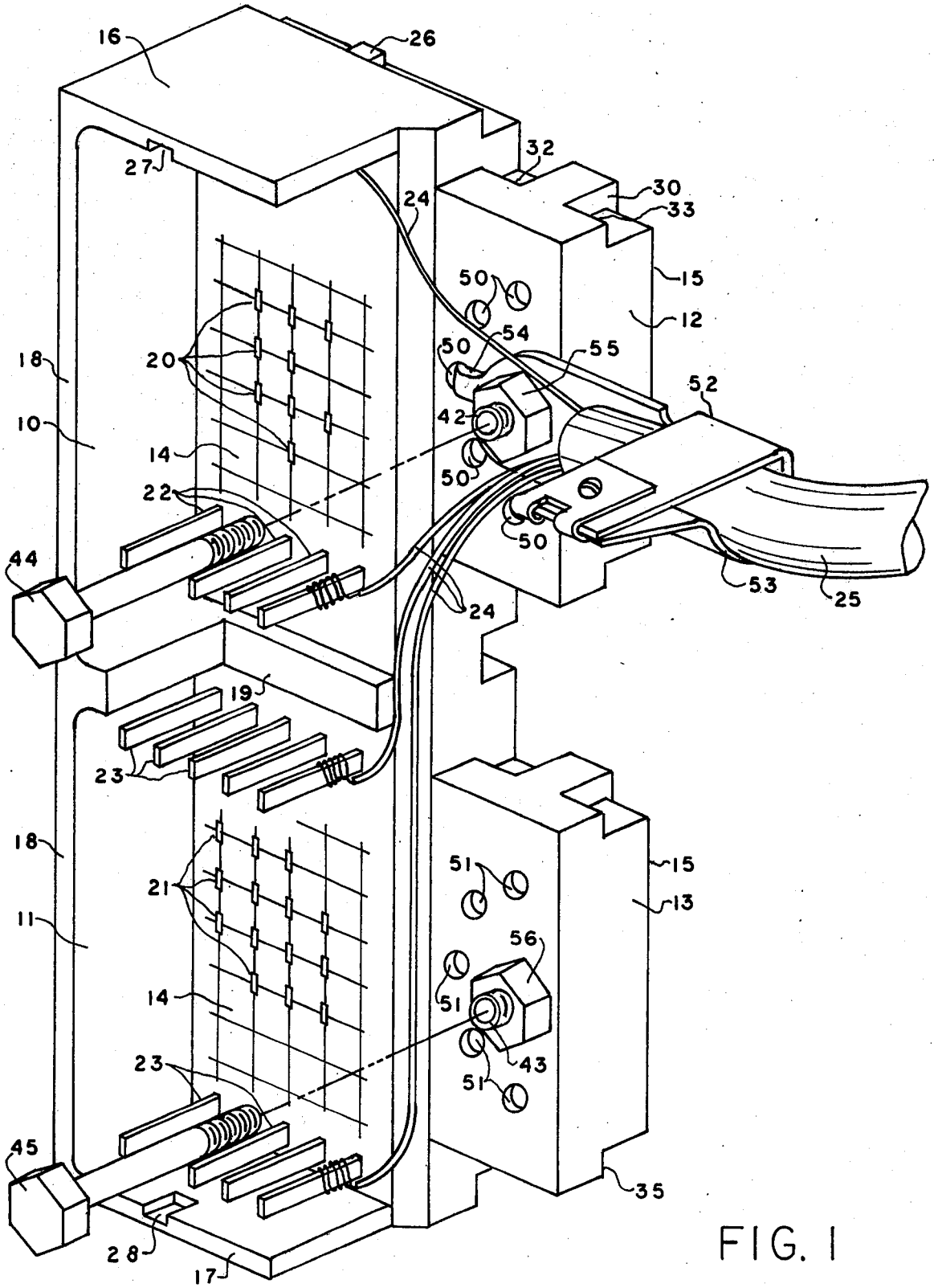
FIG. 1 is a perspective view of a pin connector of an electrical connector assembly embodying the present invention.
Figure 2:
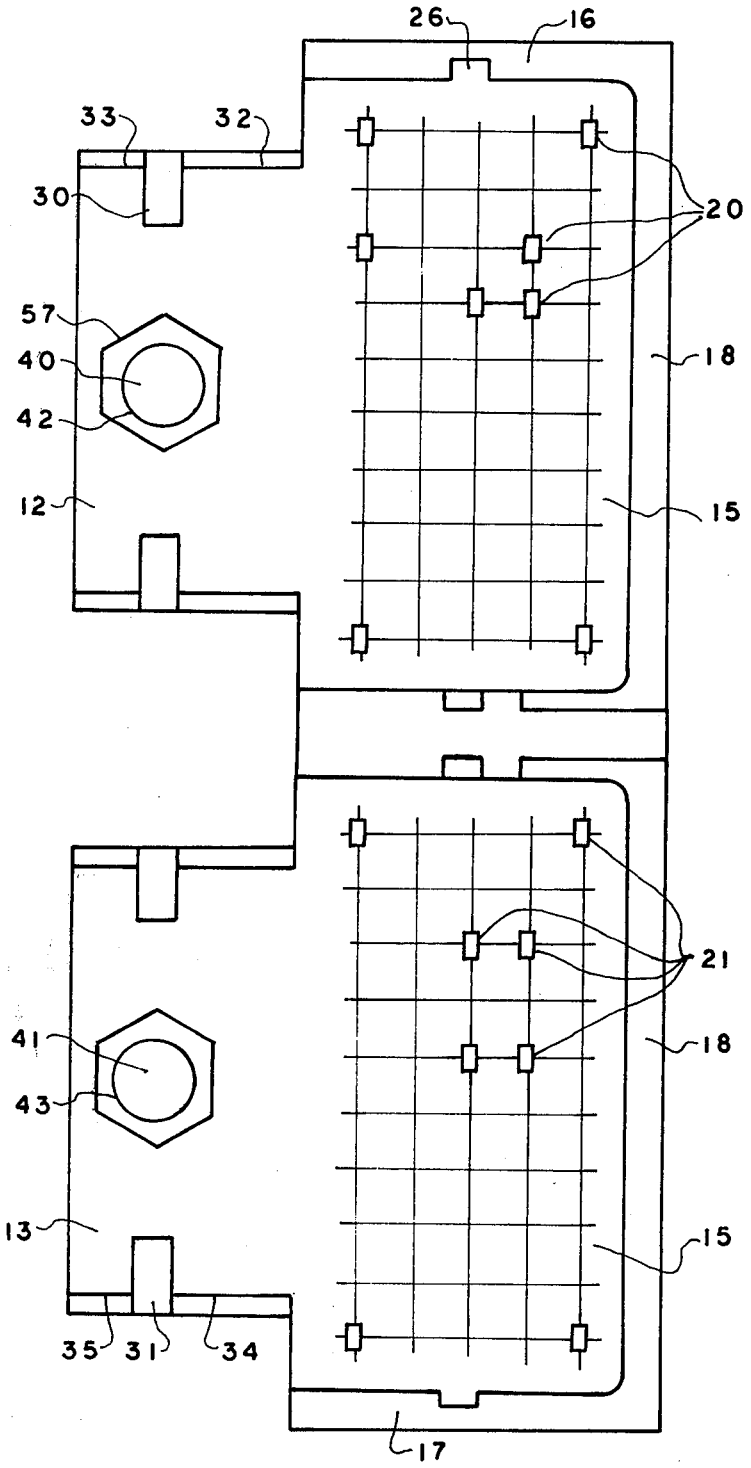
FIG. 2 is a plan view of the rear side of the pin connector of FIG. 1.

Referring now to FIGS. 1 and 2, the pin connector there shown which comprises one half of an electrical connector assembly embodying the present invention includes a partial enclosure comprising a first partial enclosure portion 10, and a second partial enclosure portion 11, a first block portion 12, and a second block portion 13.

The partial enclosure which comprises the first and second partial enclosure portions 10 and 11 includes a floor having a front surface 14, and a rear surface 15, a first end wall 16, a second end wall 17, and a side wall 18. The first end wall 16, second end wall 17 and side wall 18 extend forward from the floor front surface 14 to provide the partial enclosure. The partial enclosure also includes a divider wall 19 which also extends forward from the floor front surface and defines the first and second partial enclosure portions 10 and 11. As a result, it can be seen from the figure, that the first and second partial enclosure portions 10 and 11 are aligned.

As will be more fully appreciated later, the pin connector of FIG. 1 is molded and extracted from a mold which mold may be modified by an insert in between the mold portions which form the first and second partial enclosure portions so that the first and second partial enclosure portions may be molded separately. Thus, for those applications where only half of the pin connector of FIG. 1 is required, the same mold may be utilized.

The first enclosure portion 10 includes a first plurality of apertures 20 which extend through the enclosure floor and which are arranged in a predetermined array which, for this preferred embodiment, is an array wherein the apertures are arranged in rows and columns. In a like manner, the second enclosure portion 11 includes a second plurality of apertures 21 which also extend through the floor and which are also arranged in the predetermined array of rows and columns.

The first enclosure portion 10 also includes a first plurality of wire receiving pins 22 which are within the first plurality of apertures. For clarity, only certain ones of the pins 22 are shown. The first plurality of pins extend forward from the front surface 14 of the enclosure floor and terminate within the first plurality of apertures at a point intermediate the front surface 14 and rear surface 15. The ends of the pins within the floor may be configured in a manner as taught in Van Son, U.S. Pat No. 3,740,697, which issued June 19, 1973, and which is assigned to the assignee of the present invention.

In a similar manner, the second enclosure portion 11 includes a second plurality of wire receiving pins 23 which also extend forward of the front surface 14 of the enclosure floor and which also terminate within the second plurality of apertures at a point intermediate the front surface 14 and rear surface 15 of the floor. The ends of the pins 23 within the apertures may also be configured as taught in the previously referred to Van Son patent. Because the first and second enclosure portions are partial enclosures, access to pins 22 and 23 is readily provided to wires 24 which are contained in cable 25.

The rear dimension of the partial enclosure as can be seen from FIGS. 1 and 2 is slightly decreased in dimension from the dimension of the forward front side of the enclosure defined by the end walls 16 and 17 and side wall 18. On the rear side of the partial enclosure is provided a pair of polarizing keys, one of which is shown at 26 and at the front edge of the end walls 16 and 17 there is provided polarizing notches 27 and 28 in first end wall 16 and second wall 17, respectively. As a result, pin connectors as that shown in FIG. 1 may be stacked on top of one another if necessary for providing appropriate pin interconnections. Similar structure for accomplishing this purpose is shown in the previously mentioned Van Son patent.

The pin connector of FIGS. 1 and 2 also includes a first block portion 12 adjacent the first partial enclosure 10 on the side of the first enclosure portion opposite side wall 18. In a similar manner, second block portion 13 is adjacent the second partial enclosure 11 on the side opposite the side wall 18. Each block portion includes an alignment key, the first block portion 12 including first alignment key 30 and second block portion 13 including second alignment key 31 (FIG. 2). Alignment key 30 terminates at formed shoulders 32 and 33 of first block portion 12. In a similar manner, second alignment key 31 terminates at formed shoulders 34 and 35 of second block portion 13. Each alignment key extends in a rearward direction from the rear surface 15 on the pin connector so that, as will be explained in more detail hereinafter, the alignment keys will engage key slots on the block means of FIG. 3 when the pin connector and block means are brought together. This assures proper alignment as will be more fully explained hereinafter.

Each of the first and second block portions 12 and 13 includes an aperture, the first block portion 12 having aperture 40, and the second block portion having aperture 41. The apertures are dimensioned for receiving a bushing, the first aperture 40 receiving bushing 42, and the second aperture 41 having bushing 43. The bushings are dimensioned for receiving locking pins 44 and 45 which are utilized for securing the pin connector of FIGS. 1 and 2 to the terminal block means of FIG. 3.

Radially spaced about first bushing 42 and aperture 40 is a first set of locking recesses 50 and radially spaced about second bushing 43 and aperture 41 is a second set of locking recesses 51. The pin connector of FIG. 1 further includes first and second cable clamps, one of which is shown at 52. Only one such cable clamp is shown inasmuch as the second cable clamp associated with the second block portion 13 is identical to the cable clamp 52 which is shown. Cable clamp 52 includes a cable holding portion 53 which holds cable 25. Cable clamp 52 also includes a first opening which is dimensioned for receiving first bushing 42 and a first locking finger 54 spaced from the first opening so that when the first opening receives bushing 42, locking finger 54 may be inserted into any one of the locking recesses 50. In this manner, cable clamp 52 may be mounted onto the pin connector in any one of a plurality of angular positions which are selectable by selecting the appropriate locking recess to receive finger 54. Bushing 42 preferably includes an outer threaded portion for receiving a first bolt 55 for locking the first clamp in any one of a plurality of angular positions. Bushing 42 has a flange 57 which secures bushing 42 to the rear side 15. In a similar manner, the second cable clamp associated with the second block portion 13 may include a second finger and a second opening and is mounted in the same manner. That is to day, bushing 43 may have an outer threaded portion for receiving a second bolt 56 which locks an additional cable (not shown) in any one of a plurality of angular positions about the second bushing 43.

Figure 3:
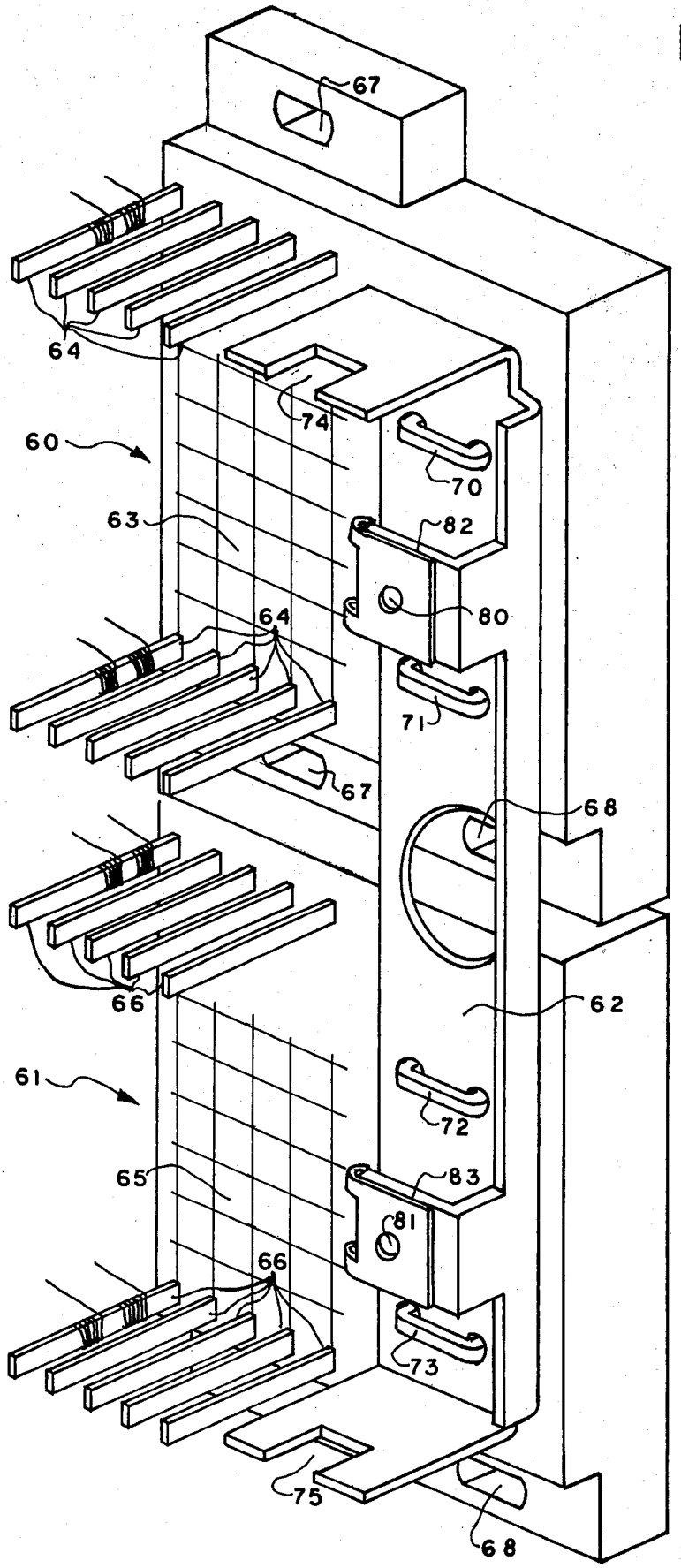
FIG. 3 is a perspective view of a terminal block means of an electrical connector assembly embodying the present invention.

Referring now to FIG. 3, there is shown a terminal block means which comprises the second half of an electrical connector embodying the present invention. The terminal block means of FIG. 3 includes a first terminal block 60, a second terminal block 61 which is substantially identical to the first terminal block 60, and a bracket 62.

The first terminal block 60 has a first planar major surface 63 and a third plurality of wire receiving pins 64. The third plurality of wire receiving pins are arranged in the predetermined array corresponding to the predetermined array of the first and second apertures of FIGS. 1 and 2 and extend forward of the first planar surface 63. In a similar manner, the second terminal block 61 includes a second planar major surface 65 and a fourth plurality of wire receiving pins 66 which are also arranged in a predetermined array and which extend forward of the second planar surface 65. The first and second terminal blocks include top mounting slots 67 and bottom mounting slots 68 for mounting the terminal block means of FIG. 3 to a rack panel or some other suitable support surface.

Bracket 62 aligns and secures the first terminal block 60 and the second terminal block 61 together. To this end, staples 70–73 are provided for securing bracket 62 to the first and second terminal blocks 60 and 61, respectively.

Bracket 62 includes a first key slot 74 and a second key slot 75 which are dimensioned for receiving the first and second alignment keys 30 and 31 of the first and second block portions 12 and 13 respectively of the pin connector of FIG. 1. Bracket 62 also includes threaded apertures or the like 80 and 81 which may be formed from Tinnerman speed clips mounted on appropriate flange portions 82 and 83. The threaded apertures 80 and 81, when the first connector and terminal block means are joined, will be in alignment with the first and second apertures 40 and 41 of the pin connector so that the locking pins 44 and 45 may be received therethrough and then through the threaded apertures 80 and 81 for securing the electrical connector together.

In operation, the terminal block means of FIG. 3 may be mounted to a rack frame or other suitable support surface. Then, appropriate wire connections may be made onto the third and fourth set of wire receiving pins 64 and 66. Suitable wire connections may also be made on the first and second set of wire receiving pins 22 and 23. Such wire connections may be made in the factory by factory personnel and computer tested for correctness.

When it is time for field installation, the installer may simply join the pin connector of FIG. 1 to the terminal block means of FIG. 3. As they are being joined, the alignment keys 30 and 31 will first engage the key slots 74 and 75 of bracket 62 to align the pin connector and terminal block means so that the first and second set of apertures 20 and 21 are in alignment with the third and fourth set of wire receiving pins 64 and 66. When the pin connector and terminal block means are joined together, the first and second set of pins 22 and 23 within apertures 20 and 21, respectively, will make contact with the third and fourth set of wire receiving pins 64 and 66. At this time, the locking pins 44 and 45 may be inserted through bushings 42 and 43 to be threaded onto threaded apertures 80 and 81 for securing the pin connector and terminal block means together. The cable 25 preferably is secured to the block portion 12 by using the cable clamp 53 in the factory. However, should an installer find that the cable 25 is being unnecessarily bent, he can loosen bolt 55 and reposition finger 54 into another recess 50 for properly positioning the cable clamp 52 into a desired angular position on the block 12 so that cable 25 is not bent. Also, the installer may want to change the angular position of clamp 52 to avoid unnecessary clutter in the rack panel.

As previously mentioned, only one half of the pin connector of FIG. 1 may be formed by properly modifying the mold which produces the pin connector of FIG. 1. If only one half of the pin connections are necessary, only one terminal block as shown in FIG. 3 is necessary and bracket 62 may be eliminated. A smaller bracket may, therefore, be secured to the terminal block and used for aligning the smaller pin connector with the single terminal block. Thus, by practicing the invention, the electrical connector may be suitably modularized to avoid unnecessary and unused pins and to also avoid the occupancy of valuable space by unused pin connector portions.

While a particular embodiment of the invention has been shown and described, modifications may be made, and it is intended in the appended claims to cover all such modifications which fall within the true spirit and scope of the invention.

What is claimed is:

1. An electrical connector assembly of the type which affords cable wire interconnections comprising:

a pin connector including, a partial enclosure having a floor comprising a front surface and a rear surface, a first end wall, a second end wall, and a side wall, said first end wall, said second end wall and said side wall extending forward from said floor front surface, said partial enclosure also including a divider wall extending forward from said floor front surface and defining first and second aligned partial enclosure portions, a first plurality of apertures extending through said floor within said first portion and arranged in a predetermined array, a first plurality of wire receiving pins within said first plurality of apertures, said first plurality of pins extending forward of said floor front surface and terminating within said first plurality of apertures at a point intermediate said front and rear surfaces, a second plurality of apertures extending through said floor within said second portion and arranged in said predetermined array, a second plurality of wire receiving pins within said second plurality of apertures, said second plurality of pins extending forward of said floor front surface and terminating within said second plurality of apertures at a point intermediate said front and rear surfaces, a first block portion adjacent said first partial enclosure portion on the side opposite said side wall, said first block including a first alignment key, and a second block portion adjacent said second partial enclosure portion on the side opposite said side wall, said second block including a second alignment key; and a terminal block means including, a first terminal block having a first planar major surface, and a third plurality of wire receiving pins arranged in said predetermined array and extending forward of said first planar surface, a second terminal block substantially identical to said first terminal block having a second planar major surface, and a fourth plurality of wire receiving pins arranged in said predetermined array and extending forward of said second planar surface, and a bracket for aligning and securing said first and second terminal blocks together and having first and second key slots for receiving said first and second alignment keys, respectively;

whereby, when said pin connector and said terminal block means are brought together, said first and second alignment keys and said first and second key slots respectively engage for aligning said first and second plurality of apertures with said third and fourth plurality of wire receiving pins respectively and for causing said first and second plurality of wire receiving pins to contact said third and fourth plurality of wire receiving pins respectively.

2. A connector assembly in accordance with claim 1 wherein said bracket includes a third and fourth threaded apertures and wherein said first and second blocks include first and second apertures respectively, said first aperture being in alignment with said third threaded aperture and said second aperture being in alignment with said fourth threaded aperture when said pin connector and said terminal block are together for receiving therethrough threaded locking pins for securing said pin connector and said terminal block means together.

3. A connector assembly in accordance with claim 2 further comprising first and second bushings within said first and second apertures respectively, said bushing also being dimensioned for receiving said locking pins.

4. A connector assembly in accordance with claim 3 wherein said first and second blocks additionally comprise first and second sets of locking recesses respectively, said first set of locking recesses being radially spaced about said first bushing, said second set of locking recesses being radially spaced about said second bushing, and wherein said connector assembly further includes first and second cable clamps, said first cable clamps having means for holding a cable, a first opening for receiving said first bushing, and a first locking finger spaced from said first opening and selectively received by one of said first set of locking recesses for locking said first clamp in one of a plurality of angular positions about said first bushing and said second cable clamp having means for holding a cable, a second opening for receiving said second bushing, and a second locking finger spaced from said second opening and selectively received by one of said second set of locking recesses for locking said second clamp in one of a plurality of angular positions about said second bushing.

5. A connector assembly in accordancewith claim 4 further comprising first and second bolts, wherein said first and second bushings include an outer threaded portion, and wherein said first and second bolts are threaded onto said first and second bushings respectively for axially securing said first and second cable clamps to said first and second bushings, respectively.

* * * * *